United States Patent [19]

Cavan, Jr.

[11] 4,269,347

[45] May 26, 1981

[54] END TAB FILE FOLDER STORAGE FILE

[76] Inventor: Donald R. Cavan, Jr., 4910 Crestland, La Mesa, Calif. 92041

[21] Appl. No.: 915,171

[22] Filed: Jun. 14, 1978

Related U.S. Application Data

[63] Continuation-in-part of Ser. No. 837,610, Sep. 28, 1977, abandoned.

[51] Int. Cl.[3] ..... B65D 5/22

[52] U.S. Cl. ..... 229/33; 206/45.31; 229/DIG. 11; 229/37 E; 229/38

[58] Field of Search ..... 206/45.31, 45.34; 229/DIG. 11, 33, 38, 37 E

[56] References Cited

U.S. PATENT DOCUMENTS

| | | | |
|---|---|---|---|
| 6,806 | 12/1875 | Reber | 229/38 |
| 720,894 | 2/1903 | Cleveland | 229/38 |
| 887,729 | 5/1908 | Kirmse | 229/38 |
| 1,511,047 | 10/1924 | Bockhorst, Sr. | 229/38 |
| 2,582,422 | 1/1952 | Ewald | 206/45.31 |
| 2,776,083 | 1/1957 | Derman | 206/45.31 |
| 2,988,412 | 6/1961 | Vannice | 206/45.31 |

FOREIGN PATENT DOCUMENTS

| | | | |
|---|---|---|---|
| 480509 | 2/1938 | United Kingdom | 229/33 |

*Primary Examiner*—Stephen P. Garbe
*Attorney, Agent, or Firm*—Brown & Martin

[57] ABSTRACT

A storage carton for storing file folders is formed of a blank made of a foldable sheet material cut and scored to define a plurality of interconnected panels which overlap to define a top, a bottom, double reinforced sides, a back and a front that includes a viewing window that is openable for access to files stored within the carton.

6 Claims, 6 Drawing Figures

END TAB FILE FOLDER STORAGE FILE

REFERENCE TO RELATED APPLICATION

This is A Continuation-In-Part of my application Ser. No. 837,610, now abandoned, filed Sept. 28, 1977 entitled "End Tab File Folder Storage File".

BACKGROUND OF THE INVENTION

The present invention relates to storage cartons and pertains particularly to a storage carton for file folders to permit access to the folders during storage.

End tab file folders have come into recent use in professional offices across the country. It is often necessary to store such folders for quick and ready accessibility when the need arises. Such folders must be stored such that if needed they are accessible. Quite frequently a high percentage of such folders are never needed, but must be readily accessible.

The usual storage arrangement for accessibility of files is the placement of cartons containing folders within shelve space in warehouses with the contents marked on the exterior of the carton so that when needed the carton may be retrieved, opened, and the contents removed.

Such storage facilities, however, are quite expensive in that extensive shelf space must be provided for the cartons.

Other forms of storage include simply stacking of cartons of files in warehouse or other storage space. This presents a problem when the file desired is located for example, in the bottom carton in a tier of several cartons. In this situation it is necessary to move all cartons from above and remove the file from the carton and replace the cartons in the stack. This is time and labor consuming and expensive.

It is therefore desirable that some inexpensive means for storage of files be available that also permits ready accessibility thereto.

SUMMARY AND OBJECTS OF THE INVENTION

It is therefore the primary object of the present invention to overcome the above problem of the prior art.

Another object of the present invention is to provide a file storage carton that permits easy accessibility to the files therein.

A further object of the present invention is to provide a storage carton that may contain file folders and may be stacked in tiers of cartons and permit the accessibility to the interior of the respective cartons without the necessity of moving the cartons.

In accordance with the primary aspect of the present invention, a storage carton for end tab file folders is provided wherein the carton is reinforced to permit stacking of tiers of filled cartons and have a front opening with a window that permits easy viewing as well as access to the contents of the carton.

BRIEF DESCRIPTION OF THE DRAWING

The above and other objects and advantages of the present invention will become apparent from the following description when read in conjunction with the drawing, wherein.

DETAILED DESCRIPTION OF A PREFERRED EMBODIMENT

Figure 1:
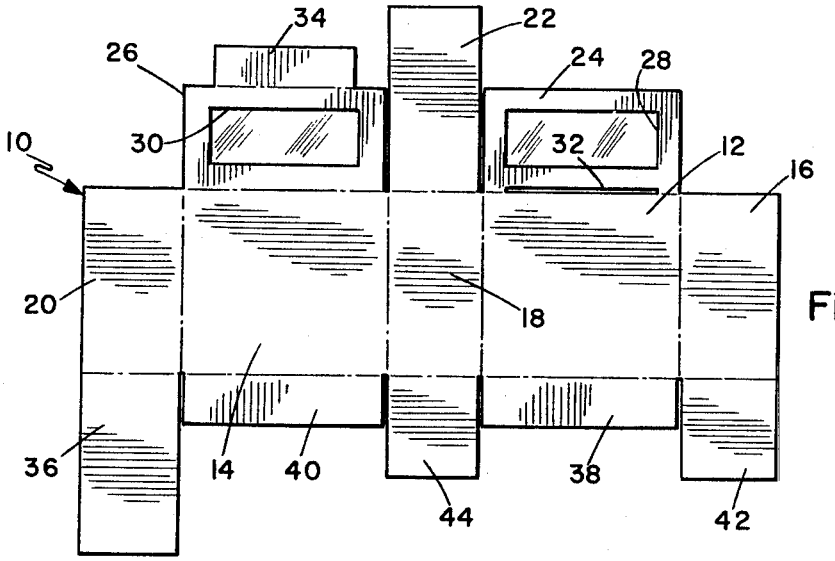
FIG. 1 illustrates the flat blank from which the storage file is constructed.

Turning to the drawing, there is illustrated in FIG. 1 a storage carton blank in accordance with the invention, which comprises a large sheet of foldable sheet material cut and scored to provide a plurality of panels hingedly connected together to form a storage carton. As best shown in FIG. 1, the blank, designated generally by the numeral 10 comprises a flat sheet of material cut and scored to define a top generally square panel 12, a bottom generally square panel 14, with a plurality of first side panels 16, 18 and 20 connected to the sides of the top and bottom panels 12 and 14. The panel 18 comprises an intermediate panel between panels 12 and 14 and the first of a panel defining that side with a panel 22 extending from the front end thereof, defining the second overlapping panel of that side panel.

The front of the carton is defined by first and second panels 24 and 26. each having windows 28 and 30 respectively, preferably including a transparent sheet of material to permit viewing through the window to the inside of the carton. These panels 24 and 26 are formed from the front edge of the top and bottom panels 12 and 14 respectively. A slit 32 formed along the juncture of panel 24 with panel 12 is adapted to receive a tab 34 extending from the end of panel 26.

The rear of the carton is formed by a plurality of rear or back panels comprising a single full panel 36 which has a generally rectangular configuration conforming to the size of the back itself, and a plurality of half panels 38, 40, 42 and 44 respectively. These are all formed and overlapped to provide reinforcing for the back of the structure. With this reinforcing the carton can more readily support other cartons thereon.

The aforementioned panels are all defined from the blank by cutting and scoring, with scoring lines shown in broken line on the blank between the respective panels to permit easy folding of the adjacent panels with respect to each other. Reference numerals have not been placed on the score lines in order to avoid excess reference numerals, which tend to clutter the drawing and add confusion.

Figure 2:
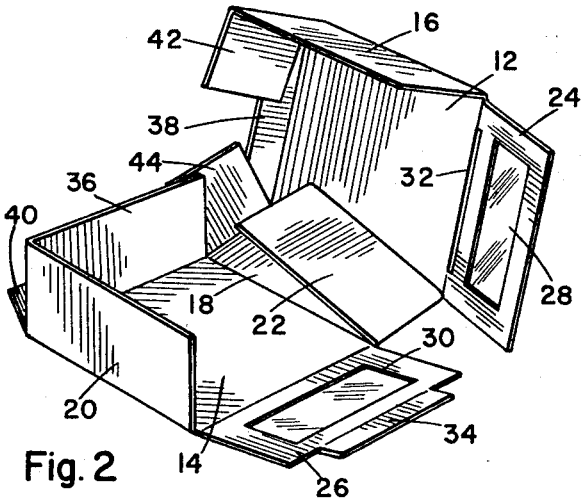
FIG. 2 is a perspective view showing the initial folding of the blank.
Figure 3:
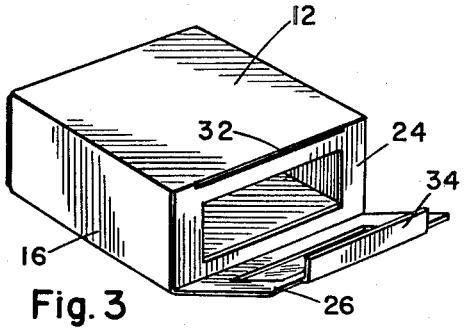
FIG. 3 is a perspective view of the assembled storage file with the front flap open.
Figure 4:
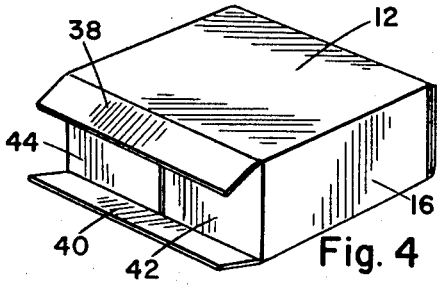
FIG. 4 is a perspective view showing the arrangement of the rear wall structure.
Figure 5:
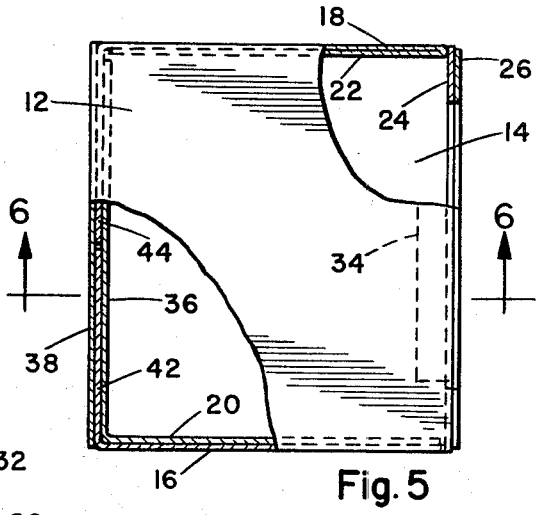
FIG. 5 is an enlarged top plan view of the storage file, with portions cut away.
Figure 6:
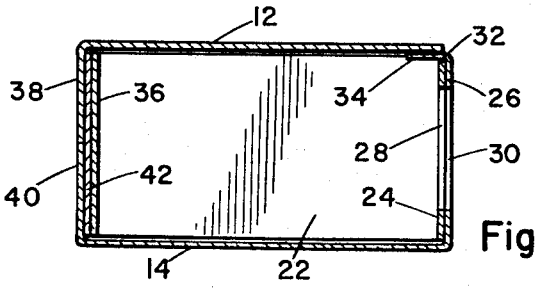
FIG. 6 is a sectional view taken on line 6—6 of FIG. 5.

The aforementioned panel or sheet of material cut and scored to define the plurality of panels as described, is foldable as shown in FIGS. 2 and 3 to form a carton as shown completed in FIGS. 3 and 4. As shown in FIG. 2, the bottom panel 14 is placed down on a flat surface, side panel 20 is folded upward with back panel 36 folded around the back. Side panel 18 with panel 22 folded over to overlap 18 is then ready for folding upward to make the opposite side of the box. Side panel 16 is then folded over from the top 12 and positioned to overlap side panel 20 to provide the reinforced side of the carton. The half panels forming the back of the carton are then folded over the back panel 36 and thus form the completed carton, as shown in FIG. 4. The front panels are then folded upward as shown in FIG. 3 to form the front closure of the carton.

With this construction, as shown in the cross-sectional FIGS. of 5 and 6, the carton is provided with reinforced sides, front and back, such that it can sustain the supporting of other cartons on top thereof. The single layered top and bottom is adequate in that it ordinarily does not support any weight. The reinforced sides and back provide additional support for the structure to permit stacking of the cartons. With the unique front end opening and windows 28 and 30, files can be inserted and removed from the cartons without removing the cartons from a stack.

This construction, as above described, also permits the viewing through windows 28 and 30 of the contents of the carton. When the carton is filled with end tab file folders, for example, with the tabs of the folders properly positioned, it can be seen that the tabs can be readily viewed through the windows and read without the necessity of even opening the cartons. When it is necessary to open a carton, the front panels are simply pulled down and opened to permit access to the inside of the carton. A file may thus be removed and reinserted in the carton without disturbing the carton or any of those resting on or below the carton. With this arrangement, a plurality of the cartons may be stacked in tiers in a warehouse or the like without the necessity of shelving and the like and without the necessity of stacking and restacking the carton when the contents must be viewed.

From the above description, it will be seen that I have provided a new and novel storage carton construction especially suited for end tab file storage.

While I have illustrated and described my invention by means of specific embodiments, it is to be understood that numerous changes and modifications may be made in the construction thereof without departing from the spirit and scope of the invention as defined in the appended claims.

Having described my invention, I now claim:

1. A storage carton blank made from foldable sheet material, said blank adapted to be folded into a rigid sided container having a front opening, said blank comprising:

a sheet of substantially rigid foldable material cut and scored to define a plurality of interconnected panels including a top panel for defining a top, a bottom panel for defining a bottom, a plurality of side panels for defining reinforced sides, a back panel for defining a back and a plurality of front panels for defining an openable front, said top and bottom panels are each generally square in configuration, said side panels comprise a pair of generally rectangular panels adapted to overlap for defining each reinforced side, one of said pair of side panels is formed of an intermediate panel between the top and bottom panel and an extension of said intermediate panel that is foldable to overlap the intermediate panel, and said front panels consist of first and second panels extending from said top and bottom panels at least one of said first and second panels having an opening that provides for viewing the contents of the container, the other of said pair of side panels is formed of first and second panels extending from the top and bottom panels, said back including panels extending from each of said top panel, said bottom panel, and said side panels, and are defined by one full size panel and a plurality of half panels.

2. A storage carton blank made from foldable sheet material, said blank adapted to be folded into a rigid sided container having a front opening, said blank comprising:

a sheet of substantially rigid foldable material cut and scored to define a plurality of interconnected panels adapted to be folded into a container and including a top panel for defining a top, a bottom panel for defining a bottom, a plurality of side panels for defining reinforced sides, a back panel for defining a back and a plurality of front panels for defining an openable front, said front panels consist of a pair of panels adapted to overlap and each extending from a separate one of said top and bottom panels, said top and bottom panels are each disposed between adjacent side panels, said side panels comprise a pair of generally rectangular panels adapted to overlap for defining each of said reinforced sides, one of said pair of side panels is formed of an intermediate panel between the top and bottom panels and an extension of said intermediate panel that is foldable to overlap the intermediate panel, and the other of said pair of side panels is formed by a pair of separate panels, each located at opposite ends of said blank and adapted to overlap to define a reinforced side.

3. A storage carton blank made from foldable sheet material, said blank adapted to be folded into a rigid sided container having a front opening, said blank comprising:

a sheet of substantially rigid foldable material cut and scored to define a plurality of interconnected panels including a top panel for defining a top, a bottom panel for defining a bottom, a plurality of side panels for defining reinforced sides, a back panel for defining a back and a plurality of front panels for defining an openable front, said top and bottom panels are each generally square in configuration, said side panels comprise a pair of generally rectangular panels adapted to overlap for defining each reinforced side, one of said pair of side panels is formed of an intermediate panel between the top and bottom panel and an extension of said intermediate panel that is foldable to overlap the intermediate panel, and said front panels consist of first and second panels extending from said top and bottom panels at least one of said first and second panels having an opening that provides for viewing the contents of the container.

4. The storage carton blank of claim 3 wherein each of said first and second panels has a generally rectangular opening covered by a transparent material.

5. The storage carton blank of claim 3, wherein the other of said pair of side panels is formed of a panel extending from the top panel and a panel extending from the bottom panel.

6. The storage carton blank of claim 5, including back panels extending from each of said top panel, said bottom panel, and said side panels.

* * * * *